United States Patent [19]

Knudsen

[11] 4,245,562

[45] * Jan. 20, 1981

[54] POWER AND FREE CONVEYOR SYSTEM

[75] Inventor: Kenneth F. Knudsen, St. Clair Shores, Mich.

[73] Assignee: Acco Industries, Inc., Trumbull, Conn.

[ * ] Notice: The portion of the term of this patent subsequent to Sep. 23, 1992, has been disclaimed.

[21] Appl. No.: 580,370

[22] Filed: May 23, 1975

Related U.S. Application Data

[60] Division of Ser. No. 376,623, Jul. 5, 1973, abandoned, which is a continuation of Ser. No. 223,689, Feb. 4, 1972, abandoned.

[51] Int. Cl.[3] ..... B61B 13/00

[52] U.S. Cl. ..... 104/172 S; 104/245; 198/685

[58] Field of Search ..... 104/172 S, 89, 247, 104/245, 172 R, 95, 96; 198/177 T, 177 R, 685; 16/106, 105

[56] References Cited

U.S. PATENT DOCUMENTS

| | | | |
|---|---|---|---|
| 3,348,496 | 10/1967 | Klamp et al. | 104/172 S |
| 3,627,595 | 12/1971 | Leach | 198/177 R |
| 3,774,546 | 11/1973 | Krammer | 104/172 S |
| 3,795,200 | 3/1974 | Pipes et al. | 104/172 S |
| 3,829,175 | 8/1974 | Vogeli | 198/177 R |

FOREIGN PATENT DOCUMENTS

| | | | |
|---|---|---|---|
| 1243858 | 9/1959 | France | 104/172 S |

*Primary Examiner*—John J. Love
*Assistant Examiner*—Ross Weaver
*Attorney, Agent, or Firm*—Barnes, Kisselle, Raisch & Choate

[57] ABSTRACT

A power and free conveyor system comprising a power track along which carriers are moved by a power conveyor. Each carrier comprises a plurality of substantially identical trolley bodies which are interconnected to one another. Each trolley body includes forwardly and rearwardly directed cantilever portions having open-ended vertical slots therein and guide wheel assemblies having axles disposed vertically in said slots.

4 Claims, 11 Drawing Figures

POWER AND FREE CONVEYOR SYSTEM

This application is a division of application Ser. No. 376,623, filed July 5, 1973 which is a continuation of application Ser. No. 223,689, filed Feb. 4, 1972, now abandoned.

This invention relates to power and free conveyor systems.

Among the objects of the invention are to provide a power and free conveyor system wherein the carrier comprises one or more trolleys that utilize a novel mounting for guide rollers.

SUMMARY OF THE INVENTION

In accordance with the invention, the power and free conveyor system embodying the invention comprises carriers, each of which comprises at least one trolley body having forwardly and rearwardly directed cantilever portions having open-ended vertical slots therein and guide wheel assemblies having axles disposed vertically in said slots.

DESCRIPTION

Figure 1:
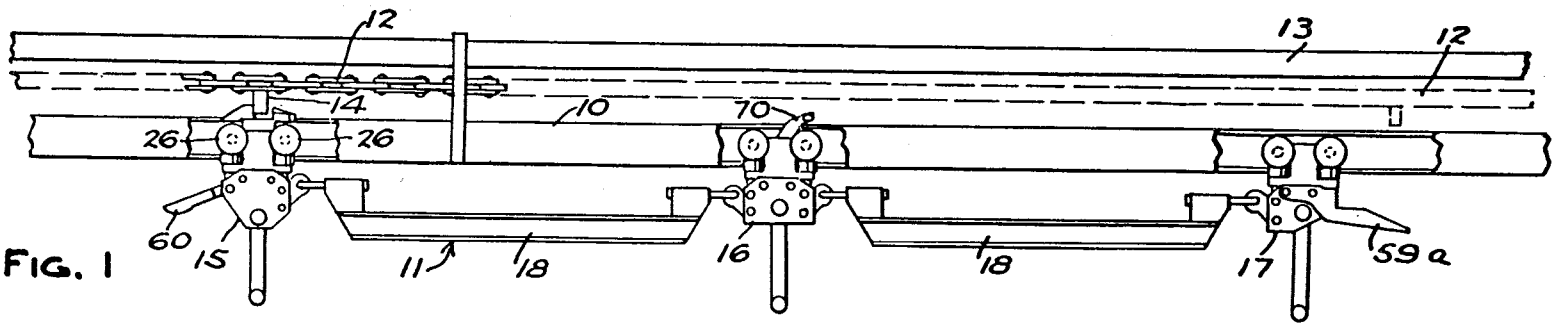
FIG. 1 is a fragmentary part sectional, part diagrammatic view of a power and free conveyor system embodying the invention.
Figure 4:
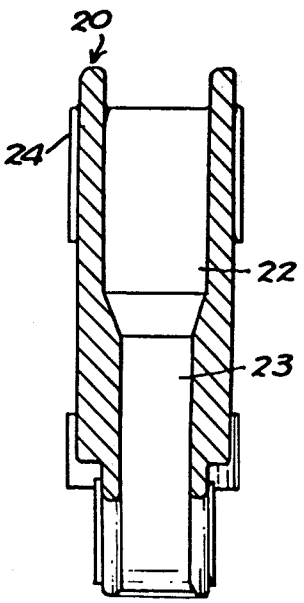
FIG. 4 is a sectional view taken along the line 4—4 in FIG. 2.
Figure 3:
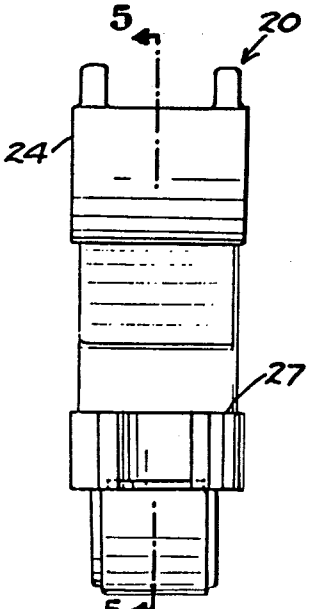
FIG. 3 is an end view of the trolley body shown in FIG. 2.
Figure 2:
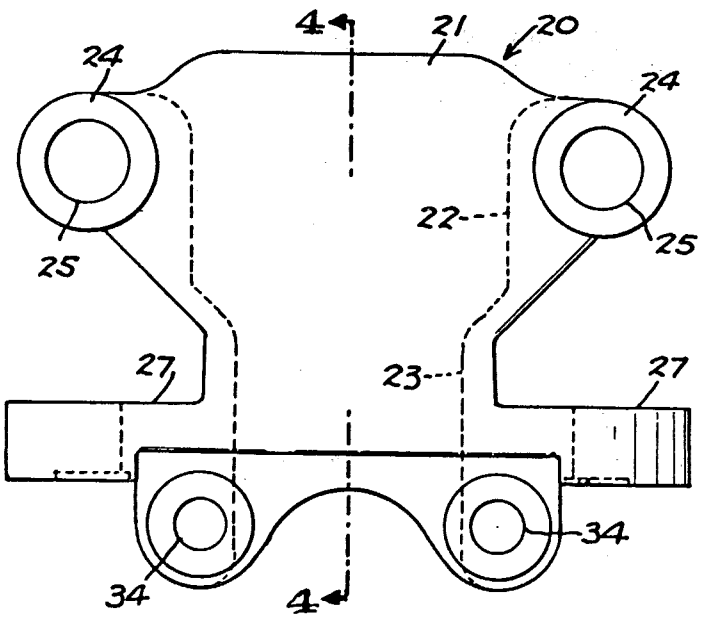
FIG. 2 is a side elevational view of a trolley body utilized in the trolleys shown in FIG. 1.
Figure 5:
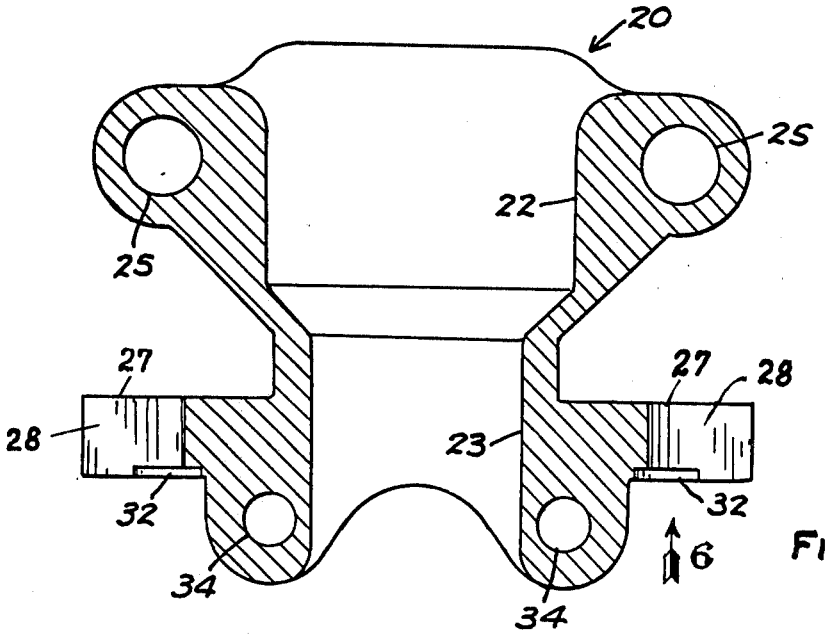
FIG. 5 is a sectional view taken along the line 5—5 in FIG. 3.

Referring to FIG. 1, the power and free conveyor system shown therein comprises a load or trolley track 10 along which carriers 11 are moved by a conveyor 12 operating on a power track 13 and having longitudinally spaced pushers 14.

The carrier shown in FIG. 1, is typical of that which might be used in a power and free conveyor system such as shown in the applications Ser. No. 853,845, filed Aug. 28, 1969, entitled "Conveyor System", of Paul Klamp, now U.S. Pat. No. 3,640,226, issued Feb. 8, 1972, and Ser. No. 30,780, filed Apr. 22, 1970, entitled "Conveyor System", of Ivan L. Ross, now U.S. Pat. No. 3,663,873, issued May 16, 1972, and comprises longitudinally spaced trolleys 15, 16, 17 that are interconnected by tie bars 18, as presently described.

Each of the trolleys 15, 16, 17 utilizes a substantially identical trolley body with the addition of various parts of elements thereon to accommodate the function to be performed by that trolley, as hereinafter described.

Referring to FIGS. 2–5, the basic trolley body 20 comprises a casting having an axially extending opening 21 therethrough which includes a wise portion 22 that tapers down to a narrower portion 23, the side walls of the portions 22, 23 being straight and parallel.

Figure 6:
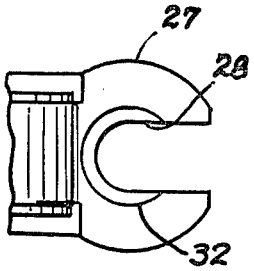
FIG. 6 is a fragmentary view taken in the direction of the arrow 6 in FIG. 5.

The body further includes forwardly and rearwardly projecting ears 24 that have openings 25 therein which receive the axles of wheels 26 that engage the flanges of the track 10 to support the trolley on the track 10. The body 20 further includes forwardly and rearwardly extending projections 27 substantially below the ears 24 that are of generally uniform width in a vertical direction and have horizontal slots 28 which are open ended. The slots 28 are adapted to receive the axles 29 of horizontal guide wheels 30. The wheels 30 comprise roller bearing mounted wheels with an inner race, rollers and an outer race. The shaft 29 has a nut 31 threaded thereon to hold the wheel in position. As shown in FIG. 6, the underside of each projection 27 is provided with a recessed arcuate portion or groove 32 that is adapted to be engaged by a washer 33 to prevent the shaft from moving longitudinally.

Figure 7:
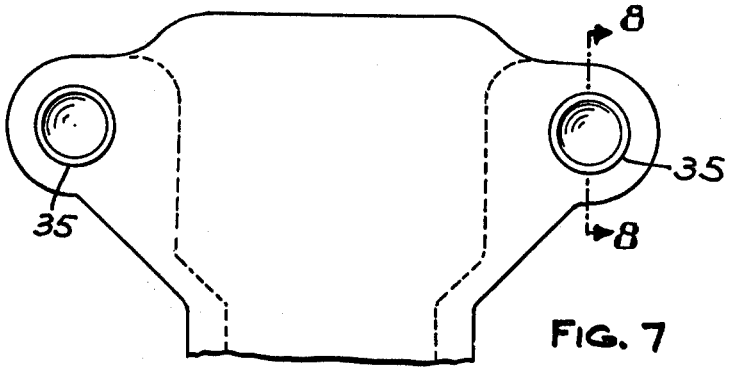
FIG. 7 is a fragmentary side elevational view of a modified form of trolley body.
Figure 8:
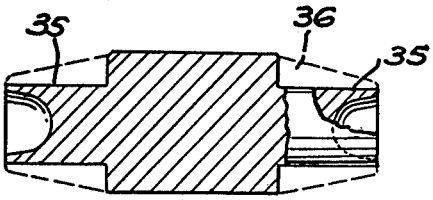
FIG. 8 is a sectional view taken along the line 8—8 in FIG. 7.
Figure 9:
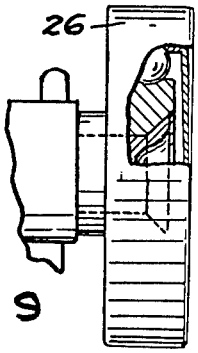
FIG. 9 is a part sectional end view of the trolley body shown in FIG. 7 with a wheel thereon.
Figure 10:
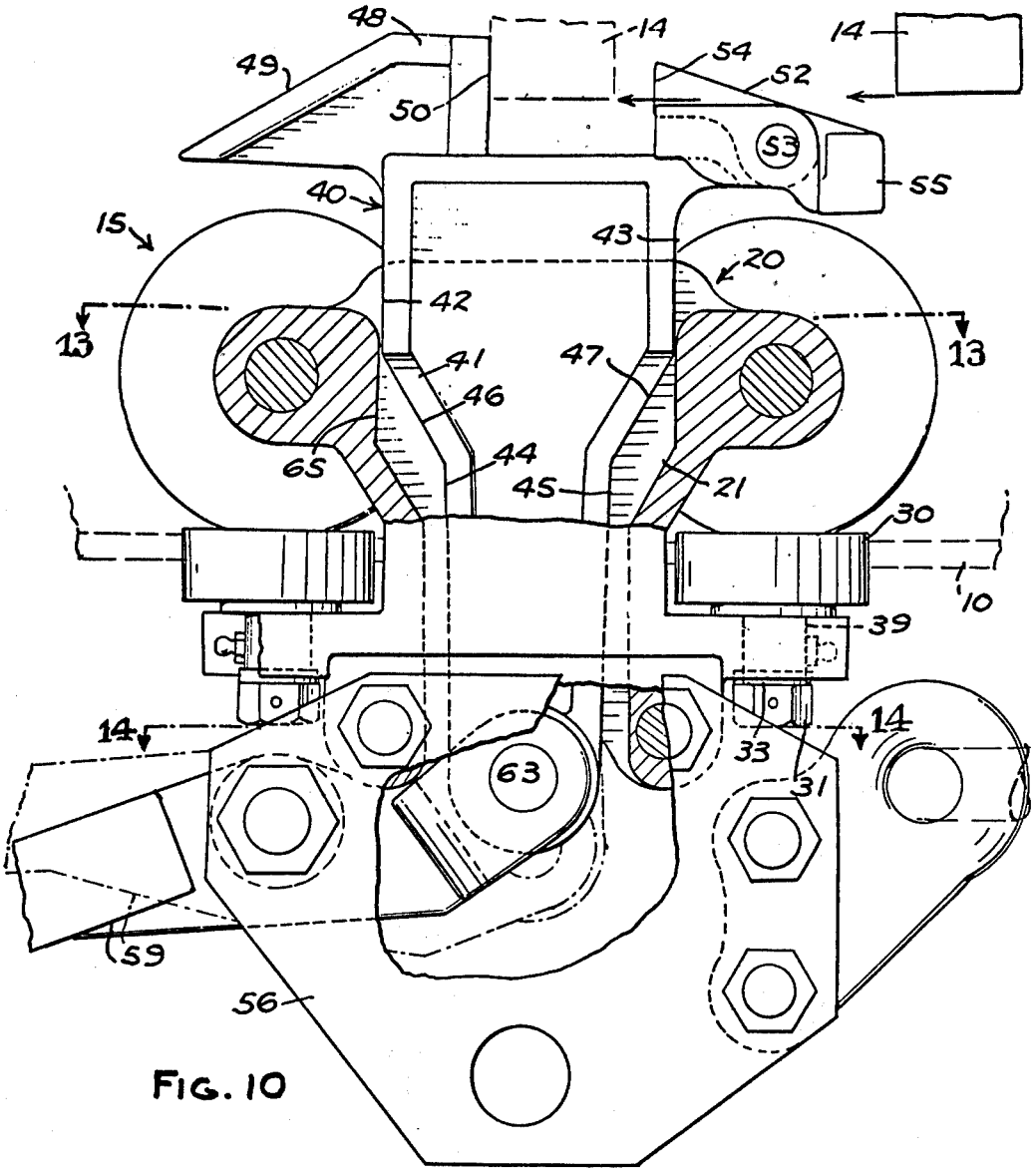
FIG. 10 is a fragmentary part sectional side elevational view on an enlarged scale of one of the trolleys shown in FIG. 1.
Figure 11:
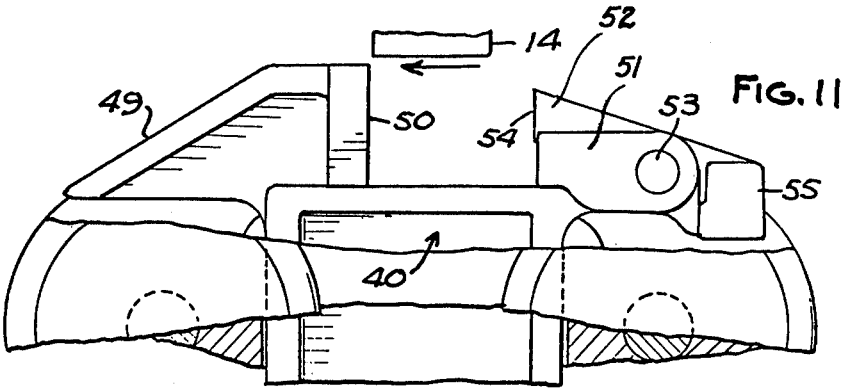
FIG. 11 is a fragmentary view similar to FIG. 10 showing the parts in a different operative position.

In the form of the trolley body shown in FIG. 7, the body comprises a single casting substantially in the same manner as that in FIGS. 2–6 except that integral laterally extending projections 35 are provided which are subsequently machined off as shown at the broken lines in FIG. 8 to remove the area 36 and define axles which can then be swaged as shown in FIG. 9 over the inner race of the wheel 26.

As further shown in FIGS. 2–5, the body 20 includes longitudinally spaced openings 35 for mounting plates and other devices as presently described.

With respect to the first mentioned trolley shown in FIG. 1, a trolley body 20 such as described above is utilized. A pusher and holdback assembly 40 is provided in the opening 21 and comprises a vertical pusher member 41 that has the general configuration and dimensions of the opening 21 including spaced upper surfaces 42, 43, spaced lower surfaces 44, 45 connected by tapered surfaces 46, 47. The member 41 is made in the form of a single casting including an upstanding integral pusher dog 48 having a tapered forward surface 49 and a vertical pusher surface 50 which is adapted to be engaged by the pusher 14 of the conveyor.

The member 41 includes upstanding walls or projections 51 rearwardly of the surface 50 of dog 48 between which a holdback dog 52 is pivoted by a pin 53 extending through the projections 51. The holdback dog 52 includes a surface 54 that is normally vertical and held in that position by an integral counter-weighted portion 55 at the rear of the dog 52.

I claim:

1. For use in a power and free conveyor system, the combination comprising a carrier adapted to be moved along a track, said carrier comprising a plurality of interconnected trolleys, said trolleys having substantially identical trolley bodies, each said trolley body having wheels thereon adapted to engage a track, each said trolley body comprising a one-piece casting having longitudinally spaced transverse axle receiving openings, substantially identical axles in said openings, and substantially identical wheels on said axles such that said bodies, axles and wheels are interchangeable, and means extending between adjacent trolleys pivotally interconnecting said trolleys, each said trolley body including forwardly and rearwardly directed cantilever portions having open-ended vertical slots therein extending forwardly and rearwardly respectively, guide wheel assemblies, each said guide wheel assembly comprising an axle having upper and lower free ends, a wheel, a roller bearing rotatably mounting said wheel on the upper end of said axle and engaging the upper surface of said respective forwardly and rearwardly directed portion, each said axle being disposed vertically in its respective slot, and a nut threaded on the lower end of said axle, each said forwardly and rearwardly directed portion including a recessed groove therein adjacent its respective slot which is generally arcuate, each said guide wheel assembly having a complementary portion thereof engaging said recessed groove and preventing longitudinal movement of said guide wheel assembly with respect to the trolley body when in such engagement such that the guide wheel assembly may be removed from the trolley body at substantially any point along the carrier track without removing said trolley from said carrier track by loosening said nut and moving said guide wheel assembly horizontally to move said axle of said guide wheel assembly through said slot.

2. The combination set forth in claim 1 wherein said recessed groove is on the underside of said respective forwardly and rearwardly directed portion.

3. For use in a power and free conveyor, a trolley comprising a trolley body including forwardly and rearwardly directed cantilever portions having open-ended vertical slots therein extending forwardly and rearwardly, respectively, guide wheel assemblies, said trolley body having wheels thereon adapted to engage a track, each said guide wheel assembly comprising an axle having upper and lower free ends, a wheel, a roller bearing rotatably mounting said wheel on the upper end of said axle and engaging the upper surface of said respective forwardly and rearwardly directed portion, each said axle being disposed vertically in its respective slot, and a nut threaded on the lower end of said axle, each said forwardly and rearwardly directed portion including a recessed groove therein adjacent its respective slot which is generally arcuate, each said guide wheel assembly having a complementary portion thereof engaging said recessed groove and preventing longitudinal movement of said guide wheel assembly with respect to the trolley body when in such engagement such that the guide wheel assembly may be removed from the trolley body at substantially any point along the carrier track without removing said trolley from said carrier track by loosening said nut and moving said guide wheel assembly horizontally to move said axle of said guide wheel assembly through said slot.

4. The combination set forth in claim 3 wherein said recessed groove is on the underside of said respective forwardly and rearwardly directed portion.

* * * * *

UNITED STATES PATENT AND TRADEMARK OFFICE

CERTIFICATE OF CORRECTION

PATENT NO. : 4,245,562

DATED : January 20, 1981

INVENTOR(S) : Kenneth F. Knudsen

It is certified that error appears in the above-identified patent and that said Letters Patent are hereby corrected as shown below:

On the cover page, under "Related U.S. Application Data", delete "abandoned" (first occurrence) and insert --now U.S. Patent No. 3,906,867--

Signed and Sealed this

***Twenty-third* Day of *June 1981***

[SEAL]

*Attest:*

RENE D. TEGTMEYER

*Attesting Officer* *Acting Commissioner of Patents and Trademarks*